United States Patent [19]
Baumann
[11] 4,290,596
[45] Sep. 22, 1981

[54] CARRIAGE BIN SYNCHRONIZATION FOR DUAL MODE COLLATOR

[75] Inventor: Gerald W. Baumann, Boulder, Colo.

[73] Assignee: International Business Machines Corporation, Armonk, N.Y.

[21] Appl. No.: 53,464

[22] Filed: Jun. 29, 1979

[51] Int. Cl.[3] ..... B65H 39/115
[52] U.S. Cl. ..... 271/292; 271/207; 271/296
[58] Field of Search ..... 271/296, 297, 292, 287, 271/288, 289–291, 293–295, 279, 207, 212; 270/58

[56] References Cited

U.S. PATENT DOCUMENTS

| | | | |
|---|---|---|---|
| 3,709,492 | 1/1973 | Baker et al. | 271/297 X |
| 3,851,872 | 12/1974 | Gerbasi | 271/291 |
| 3,998,450 | 12/1976 | Howard | 271/293 |
| 4,141,546 | 2/1979 | Queener | 271/288 |
| 4,170,349 | 10/1979 | Baumann et al. | 271/296 |
| 4,190,247 | 2/1980 | Guenther | 271/291 |

FOREIGN PATENT DOCUMENTS

| | | | |
|---|---|---|---|
| 2502018 | 7/1975 | Fed. Rep. of Germany | 271/292 |

*Primary Examiner*—Bruce H. Stoner, Jr.
*Attorney, Agent, or Firm*—Joscelyn G. Cockburn

[57] ABSTRACT

Universal sorting device for collating face-up, face-down, simplex and duplex copies outputted from a copier, offset press, or similar device. The sorting device includes a plurality of bins configured with a fixed module and a movable module. The fixed module includes a plurality of side walls orientated in a generally vertical direction. The movable module includes a throat plate having a plurality of openings with bottom walls orientated in a substantially horizontal direction. A mechanism shifts the movable module to align the bottom walls with the side walls to form the integral bins with associated openings to insert the copies.

7 Claims, 12 Drawing Figures

CARRIAGE BIN SYNCHRONIZATION FOR DUAL MODE COLLATOR

BACKGROUND OF THE INVENTION

1. Field of the Invention

The invention relates to sorters and collators adapted for use with printers, copiers, and the like devices. In particular, the invention relates to sorters which collate copies outputted from printers and/or copiers adapted to output copies in a face-up, face-down, simplex, and duplex mode.

2. Prior Art

The use of sorting devices for collating copies produced by copiers, printers, or the like is well known in the prior art. Prior art sorting devices include a plurality of bins adapted to support a set of copies generated from a set of original documents. Each bin has an associated opening through which the copies are inserted by a sheet delivery mechanism. The sheet delivery mechanism may be of the traveling deflector type or the multiple deflector type.

For practical purposes, the majority of sorters coact with duplicators/copiers to reproduce collated copies of original documents. In order to reproduce satisfactory collated copy sets, having the proper orientation between the documents in a set, it is necessary that the collator be arranged to handle (i.e. stack) copies reproduced from different types of copiers/duplicators. Usually the type of copier/duplicator is determined by the orientation of the copy sheet as it exits the copier/duplicator. The copy sheets usually exit the copier/duplicator in one of two orientations; the so called "Face-up" and the so called "Face-down" orientation. In the Face-up orientation, the side of the copy sheet which has the reproduced information thereon is facing upwardly from the exit tray. This allows an operator standing relative to the copier/duplicator to make a quick decision as to whether or not the quality of the copy is satisfactory. Likewise, the Face-down orientation is the reverse of the Face-up orientation. This means that in the Face-down orientation, the reproduced information which is on the copy sheet faces the bottom of the exit tray.

The mode in which the copier/duplicator operates further limits the arrangement of the collator. Usually the prior art copier/duplicator operates in either the duplex mode or the simplex mode. In the duplex mode information is reproduced on both sides of the copy sheet. In the simplex mode, information is reproduced on only one side of the copy sheet. To use a single collator to collate simplex and duplex copiers requires the use of an inverting device to invert the sheets for different modes of operation.

U.S. Pat. No. 3,851,872 exemplifies a prior art sorting apparatus for collating simplex and duplex copies. The sorting apparatus consists of a support frame adapted to be positioned adjoining to a copier/duplicator device and to receive copies therefrom. A rotatable assembly having a plurality of trays are mounted onto a hub support member. The trays extend radially from said hub. The hub support member is mounted to a rotatable shaft. The rotatable shaft is mounted to the support frame. Two spaced-apart paper delivery channels are positioned relative to the bins. Each of the channels is dedicated to deliver either simplex or duplex copies to individual bins. A deflector gate positioned in the paper path of the copy sheet deflects the sheet to either the simplex paper delivery channel or the duplex paper delivery channel. By selecting the direction in which the assembly rotates, the device collates simplex or duplex copies. A more detailed discussion of this type of prior art collator is given in the subject patent.

U.S. Pat. No. 3,998,450 discloses a sorting device for collating sheets from machines running in the simplex or the duplex mode of operation. The sorting device consists of a vacuum transport assembly carrying a two-position pivotable deflector member. The transport moves past a horizontal array of vertical tray assemblies. Each of the trays is fitted with a pivotable deflector plate member. The deflector plate member is positioned at the inlet of each tray. The two position pivotable deflector member coacts with the deflector plate member to stack collated sheets at the right or left side of the tray assemblies.

As is evident from the above, the described prior art sorting devices are suitable for collating simplex or duplex copies only. The prior art sorting devices are not capable of collating copies outputted from face-up or face-down type copiers/duplicators. By having a sorting device which is capable of collating copies from a face-up or face-down type copier/duplicator, the need to have different types of sorting devices is eliminated. Also, collator manufacturers can store only one type of collator. Additionally, if a customer elects to change a copier/duplicator from a face-up type to a face-down type or vice versa, the adjustment on the old collator can be done in the customer's office without installing a new collator. The overall effect is to reduce cost to the customer.

Although the prior art collators appear to work satisfactorily for the intended purposes, a substantial amount of hardware including flipper gates in the paper path are added to and needed in the basic collator. The additional hardware tends to increase the unit cost and increase the mechanical complexity of the device. Increased mechanical complexity tends to reduce the overall reliability. Also the addition of the flipper gates in the paper path is the least desirable since a malfunctioning of the gate may result in a paper jam which usually requires the service of a trained technician to clear the jam.

Also, the approach which the prior art uses to enable a sorting device to operate with a copier/duplicator running in either the simplex or duplex mode may not be applicable with certain types of collators. For example, the mini collator/sorter disclosed in U.S. Pat. No. 4,141,546.

It is, therefore, the general object of the present invention to implement a universal collator/sorter which can be used with any type of copier/duplicator device.

SUMMARY OF THE INVENTION

According to the teaching of the present invention, the collator/sorter is a multi-bin device suitable for collating copy sheets outputted from any type of copier, duplicator or the like devices. The collator/sorter is relatively small in comparison to the copier/duplicator and is mounted to the copier/duplicator at a point where copies are outputted. The collator/sorter may replace the conventional copier/duplicator exit tray.

The collator/sorter includes a fixed module, an adjustable module and an indexing means. The indexing means periodically indexes the adjustable module to align the same with the fixed module. When aligned the fixed module and the adjustable module form a unified multi-bin collator/sorter.

The fixed module includes a plurality of spaced bin side wall members. The spacing between the side wall members are designed to accommodate a predetermined number of copies. The members are positioned in a substantially vertical orientation.

The adjustable module includes a deflector unit adapted for incremental movement along a rack gear. The direction of motion of the deflector unit is traversed to the orientation of the side wall members. An integral throat plate, having a plurality of bin bottom wall members interspersed with a plurality of slots or openings, is mounted to the rack gear. The paper delivery mechanism or the deflector unit is aligned with the slots in the throat plate. The adjustable means is connected to the rack gear and adjusts the same so that the bin bottom wall members of the throat plate are aligned with the bin side wall members of the fixed module to form a unified structure.

In one feature of the invention the alignment occurs statically. For example, at the time when the copier/duplicator is initially set up.

In another feature of the invention the alignment occurs dynamically, that is on a demand time basis. For example, when an operator selects a simplex or a duplex mode of operation of the copier/duplicator.

In still another feature of the present invention the number of bin bottom wall members is at least one greater than the number of bin side wall members.

In yet another feature of the present invention the number of bin side wall members is at least one greater than the number of bin bottom wall members.

The foregoing and other features and advantages of the invention will be apparent from the following more particular description of preferred embodiments of the invention, as illustrated in the accompanying drawings.

DESCRIPTION OF THE PREFERRED EMBODIMENT

Figure 1:
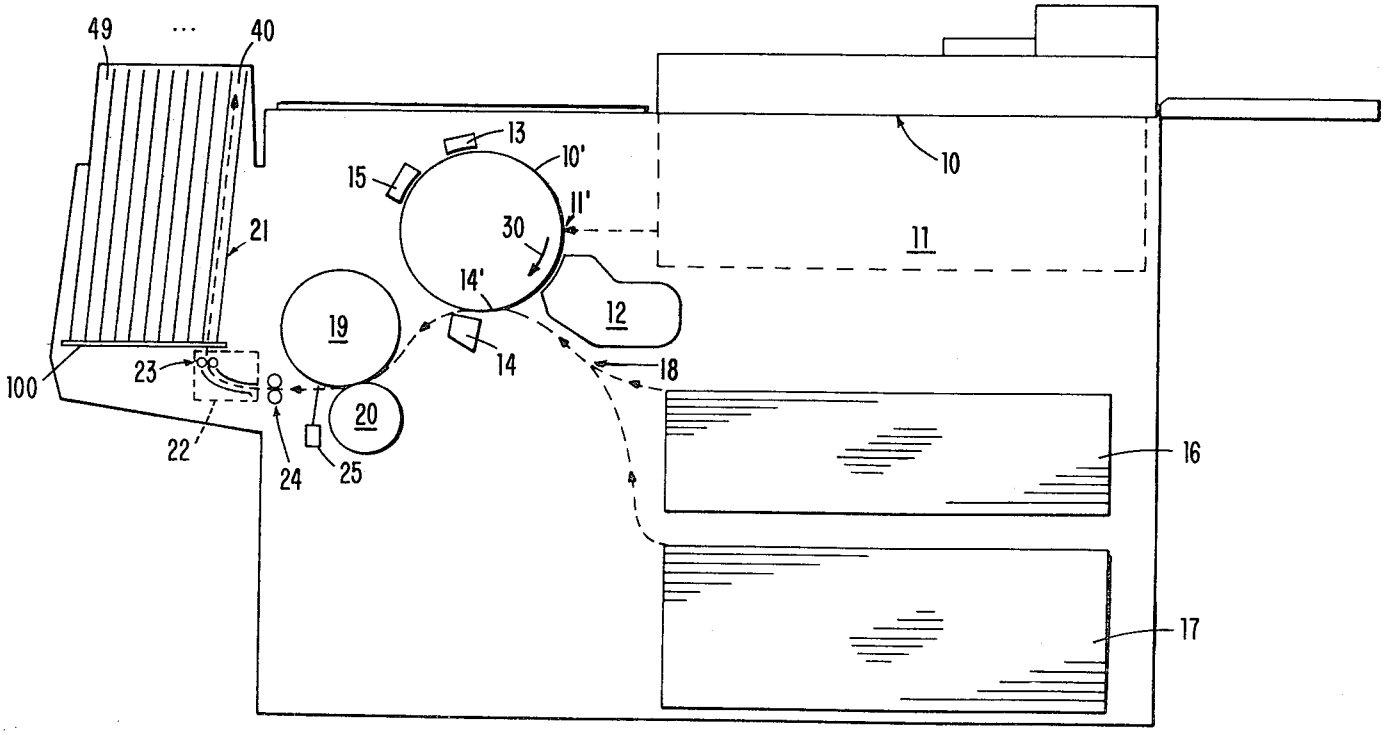
FIG. 1 shows a schematic view of the copy paper path of an electrophotographic copier incorporating a collator/sorter according to the teachings of the present invention.

FIG. 1 shows a diagramatic drawing of an electrophotographic copier machine of the transfer type which will be used to describe the utility for the instant invention. Although the present invention is shown in combination with an electrophotographic copier machine, this showing should not be construed as a limitation on the scope of the present invention since the invention is suitable for use with any paper sorting machine where collation is needed. In this type of electrophotographic copier an electrophotographic drum 10' is journaled for rotation in a path shown by arrow 30. The periphery of the drum is fitted with a photosensitive covering often referred to as a photoconductor. As the drum rotates, the photoconductor layer is charged with a uniform charge from charging corona 13. Prior to performing the charging function, an original document is positioned face down on the document glass 10. The document is imaged through the use of an illumination and optical system shown generally at 11. A latent image of the original document is impressed on the photoconductor at imaging station 11'. The latent image is then developed or toned at developing station 12. As the photoconductor continues to rotate, the developed image thereon is transferred to a sheet of copy paper at transfer station 14'. The transfer function is effectuated by a transfer corona 14. The photoconductor continues to rotate, after transfer, through a precleaning corona 15 and to a cleaning station, not shown, but which may be combined with developing station 12 if desired. Copy sheet is fed from either bin 16 or bin 17 along paper path 18 to the transfer station 14'. At the transfer station, the leading edge of the copy paper is mated with the leading edge of the developed image on the photoconductor. After transfer, the copy paper continues to move along the copy paper path into a fusing station represented by rolls 19 and 20 respectively. At the fusing station, the developer material which has been transferred to the copy sheet is fused thereto to form a permanent copy. After leaving the fusing station the paper is transported into one of the bins of collator 21.

By way of example, the selected bin is determined by the position of a movable deflector unit 22. Transport rolls 23 are carried by the movable deflector unit and positioned adjacent openings in the throat plate 100. The throat plate in turn is aligned with the vertical walls of the collator bins thereby forming an integral unit.

In addition to using a traveling deflector for deflecting the sheets into a selected bin, a plurality of deflectors may be positioned one at each bin, and as a sheet of paper travels by the deflector unit associated with the selected bin, directs the sheet into said bin. Since the method and device used for deflecting a particular sheet into a selected bin does not form part of the present invention and it is within the skill of the art to devise a plurality of deflection schemes and apparatus, the details of the deflection scheme will not be discussed any further. By way of example, a more complete discussion of a deflection scheme and apparatus which can be used is given in U.S. Pat. No. 4,190,247.

Likewise, the electronics used for selecting a particular bin does not form part of the present invention and will not be discussed in detail. A detailed description of the electronics and method for selecting a particular bin is disclosed in the above referenced patent. Suffice it to say that exit roll means 24 as shown in FIG. 1 together with a paper sensing switch 25 located near the exit of the fusing station cooperate so as to transfer a sheet into the traveling deflector mechanism. Switch 25 is designed to sense the presence of paper leaving the fusing station, and when the paper is completely removed from the fusing station, enables transport rolls 23 to increase in speed. While the paper is still in the fusing station, rolls 23 are rotated at a linear speed which matches the speed of the paper through the fusing station in order to avoid scrubbing on the surface of the paper, which causes roll wear and builds up electrostatic charge on the paper.

Figure 2:
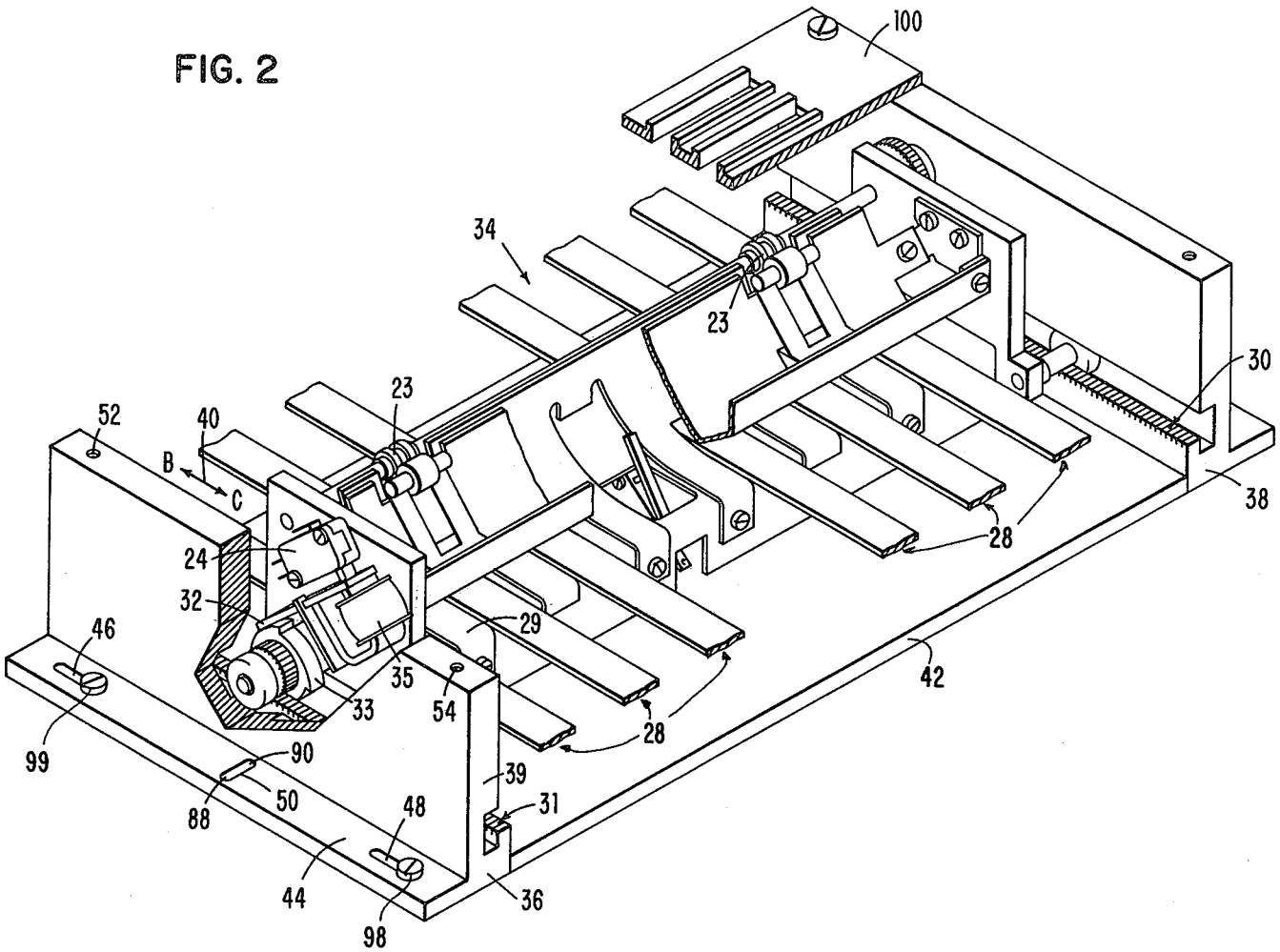
FIG. 2 is a perspective view of the deflector unit with the throat plate and indexing mechanism attached thereto.

Referring now to FIG. 2, a perspective view of the collator including rack gear, deflection mechanism and adjustable means according to the teaching of the present invention is shown. The collator includes a sheet delivery mechanism 34 adapted for linear motion on rack gears 36 and 38 respectively in the direction shown by arrow 40. In operation, the paper enters the sheet delivery mechanism 34 along the top surface of guide surfaces or belts 28 of which six are shown in FIG. 2. As the edge of the paper moves along the guide surfaces or belts 28 the paper moves into the curve of rails 29, of which there are six shown in FIG. 2. The paper is then deflected along the top surface of guide rails 29 into transport rolls 23, of which there are two shown in FIG. 2. Sheet delivery mechanism 34 is moved in either direction B or direction C of arrow 40 along gears 31 and 30 of rack gear assemblies 36 and 38 respectively. The sheet delivery mechanism, as it travels along its predetermined path, is positioned under the opening of one of the collator bins by holding the sheet delivery mechanism against one of the stop edges of ratchet 33. When motion is desired in direction C for example, the cooperating dog 32 is lifted away from the ratchet 33 by solenoid 35. If motion is desired in direction B, ratchet 33 is turned without energization of solenoid 35. When dog 32 reaches a high point of ratchet 33, switch 24 is released signaling the approach of a stop edge ratchet 33. In that manner, switch 24 tracks the advance of ratchet 33 and through that mechanism, it enables the machine logic control to track the number of bins at which the deflector unit is at. A driving means such as a motor (not shown) drives the paper delivery mechanism 34 via a plurality of gears. A controller (not shown) generates electrical signals for the drive means so that the sheet delivery mechanism is transported incrementally along gear racks 36 and 38 respectively.

Still referring to FIG. 2, the rack gear assemblies 36 and 38 have a substantially truncated I-beam cross-sectional area. The base section of the I-beam extends on both sides from the central portion 39 and is attached to the collator base 42. The collator base 42 supports the collator structure. The rack gear assemblies 36 and 38 are identical in construction. Therefore, only one will be described in detail, it being understood that the other rack gear is identical to the one described. Gear teeth, for example, 31, are fabricated on the top surface of one of the extending base portions of the I-beam. A mating gear on the sheet delivery mechanism is transported along the geared surface of the rack gear. The other extended base portion 44 is fitted with a first set of elongated locking holes 46 and 48 respectively. The function of the elongated locking holes are to allow locking screws to connect the rack gears to the base portion of the collator. An elongated selector slot 50 is positioned on base portion 44. The elongated axis of the selector slot runs in a direction substantially perpendicular to the elongated axis of the elongated locking holes 46 and 48 respectively. As will be explained subsequently, the selector slot, together with the locking holes, a selector lever, and a plurality of locking screws function to index the gear racks so that the throat plate 100 which is mounted on the truncated portion of said rack gear assemblies, align the integral throat plate of the collator with the vertical side walls of said collator to form a front stacking or a back stacking collator.

Still referring to FIG. 2 the I-portion 39 of the rack gear extends upwardly above its base. A flat surface is placed on the top of I-portion 39. The flat surface is fitted with a plurality of holes such as 52 and 54. The throat plate 100 (FIG. 6) is fastened to the rack gear by a plurality of fastening screws.

Figure 6:
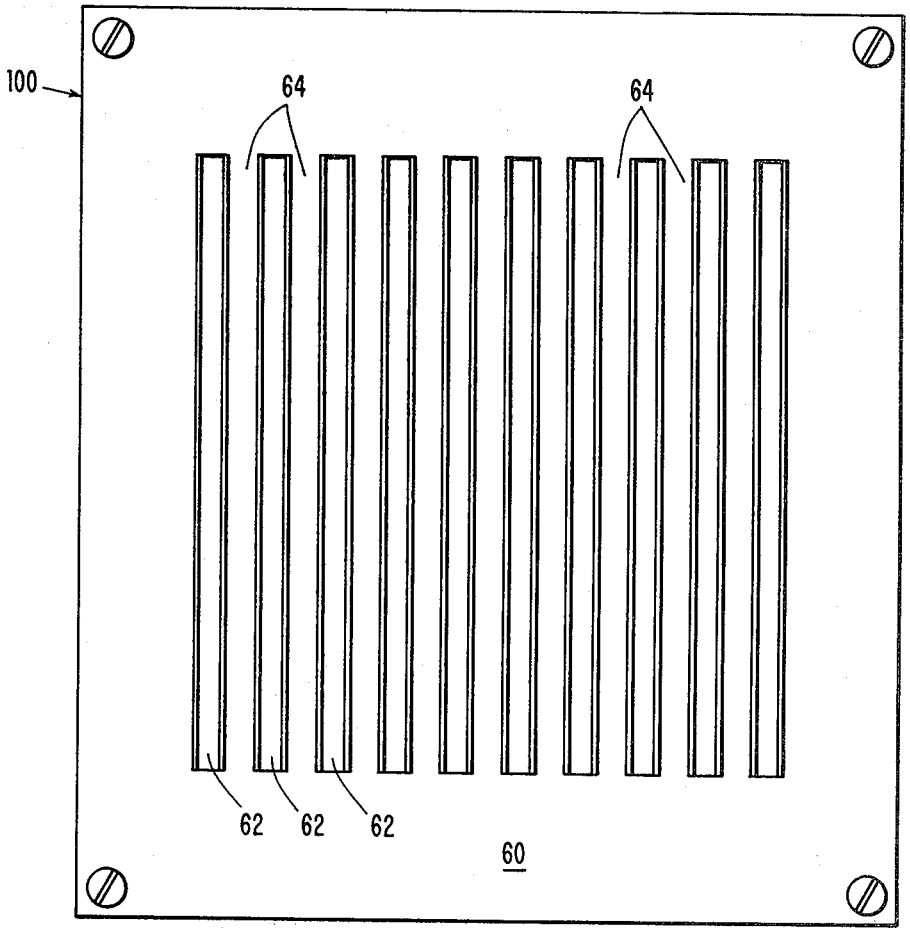
FIG. 6 shows a top view of the throat plate.

Referring now to FIG. 6 for the moment, a perspective view of throat plate 100 is shown. The throat plate includes a substantially flat member 60 having holes through which the screws are inserted to attach same to the rack gears of FIG. 2. The member 60 is fabricated with a plurality of slots 62. Intermediate a pair of slots is a solid member 64. When the throat plate is mounted to the rack gear assemblies 36 and 38 (FIG. 2) respectively, the relationship is such that as the paper delivery mechanism travels in its path along the rack gears, the slots are in alignment with the transport rolls 23. Likewise, the solid portions of the throat plate are aligned with the vertical portions or walls of the collator so that after sheets are hurled through the slots, they are supported on the bottom by the solid members 64, while the vertical side walls form the supporting sides of the collator.

Figure 4:
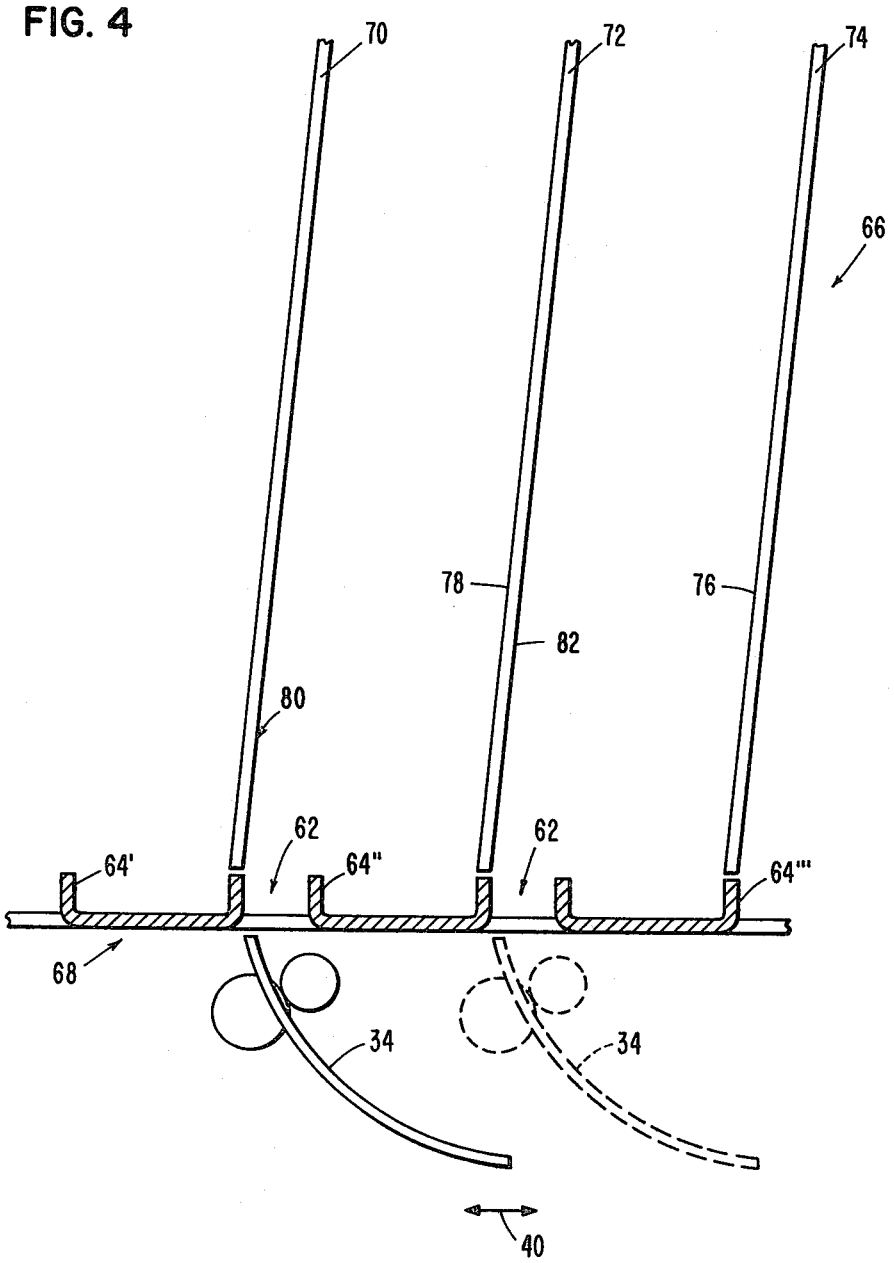
FIG. 4 shows a partial side view of the collator/-sorter. The drawing is helpful in understanding the present invention.

Before addressing the adjustment feature of the present invention, it is worthwhile turning to FIG. 4 for the moment. FIG. 4 shows a conceptual drawing of the present invention in cross-section. This drawing is helpful in understanding the inventive feature of the present invention. In this drawing only a few bins of the collator are shown. It should be understood that the showing can be transformed into any desired number of bins. The collator includes a fixed module 66 and a selectively movable or adjustable module 68. The fixed module includes a plurality of side walls 70, 72, and 74 respectively. Although only three side walls are shown, any number of side walls may be used depending on the number of bins needed in the particular collator. The side walls are attached to the frame of the collator. Likewise, the selectively movable module 68 is the integral throat plate. As was stated previously, the selectively movable module 68 includes a plurality of solid members 64 interspersed with slots 62. A deflector mechanism 34 travels in the direction of arrow 40 to deliver sheets through the slots. The points at which the deflector mechanism stops to deliver sheets through the slots is hereafter called the register stop positions. The solid portions 64 of the selectively movable module, hereinafter called the bottom walls 64, cooperate with the side walls to form the bins of the collator. By way of example, let it be assumed that the drawing in FIG. 4 depicts a two bin collator. Further, let it be assumed that the collator can collate in one of two positions. In one position, hereinafter called the back wall position, the bottom wall bin members 64'' and 64''' are aligned with the side wall members 72 and 74 respectively. In this orientation, as the sheet delivery mechanism 34 travels along its path, the sheet is delivered to the bins and rest on front wall 76 and 78 of side wall members 74 and 72 respectively. As is evident from the drawing, when the device operates as a back wall stacker, bin bottom wall member 64' is superfluous and is not used.

The other position in which the collator can be operated, is the so called front wall stacker. As a front wall stacker, side 80 and 82 of side walls 70 and 72 are used to support the sheet. To configure the collator in a front wall stacker, the bottom support bin walls are shifted so that the unused bottom wall 64' now aligns with vertical wall 70. Likewise, bottom wall 64'' aligns with vertical wall 72. In essence, in order to achieve a collator having N bins, then the number of bottom walls must exceed the number of bins of the collator by one. An alternate way of achieving an N bin collator is that the number of bottom walls be equal to the number of bins, but the sheet delivery mechanism has one more register stop position than bins. In the example shown in FIG. 4 a two bin collator is configured by using three selectively movable bottom walls, three fixed vertical side walls, and two register stop positions. Alternately, a two bin collator can be configured by using three fixed side walls such as sidewalls 70, 72 and 74, two movable bottom walls, and three register stop positions. By way of examples FIGS. 8 through 11 shows schematic of various configurations wherein the movable module of the collator coacts with the fixed module including the vertical walls to form a back stack or front stack collator.

Figure 8:
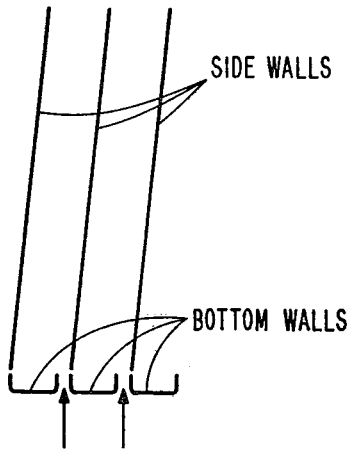
FIG. 8 through 11 shows alternate configuration of the collator modules to achieve back stacking or front stacking of sheets.
Figure 9:
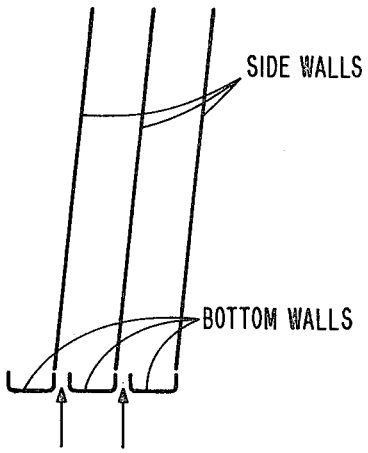

In FIGS. 8 and 9, the collator has three side walls and three bottom walls with the sheet delivery mechanism (not shown) having two registered stop positions. The registered stop positions are indicated by the arrows. FIG. 9 shows the collator configured as a front wall stacker. In this configuration, one bottom wall is not used. FIG. 8 shows the collator configured as a back wall stacker. In this configuration another bottom wall is not used.

Figure 10:
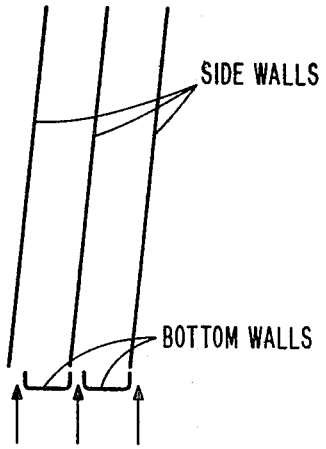
Figure 11:
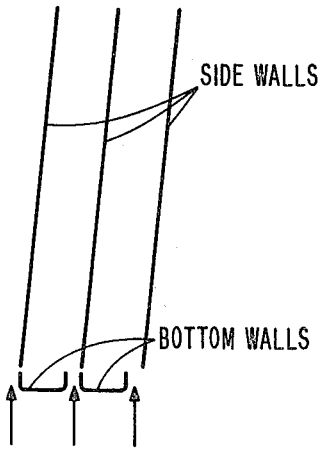

FIGS. 10 and 11 show the configuration where the collator has three side walls, two bottom walls and three registered stop positions. FIG. 11 shows the collator configured as a back wall stacker; while FIG. 10 shows the collator configured as a front wall stacker. In either configuration shown in FIGS. 10 and 11 respectively, one of the registered stop positions is not used.

Returning now to FIG. 2, in order to index the bin bottom walls to be in alignment with the vertical walls, the rack gear assemblies 36 and 38 which supports the throat plate are adjusted to one of two positions via selector slot 50 and locking slots 46 and 48 respectively. The alignment relationship between the delivery rolls 23 of the sheet delivery mechanism 34 and the slots in the throat plate is always constant, therefore there are no adjustments between the throat plate and the associated delivery mechanism. Assume that the collator is functioning in one of its two modes of operation (that is a front stack or back stack collator). If it is necessary to change to the other mode, the locking screws are loosened and shaft 84 (FIGS. 3A and 3B) of selector knob 86 is rotated from position 88 of selector slot 50 through the second position 90 of said slot. Once at position 90, the locking screws are fastened and the collator now collates in its other mode.

Figure 3A:
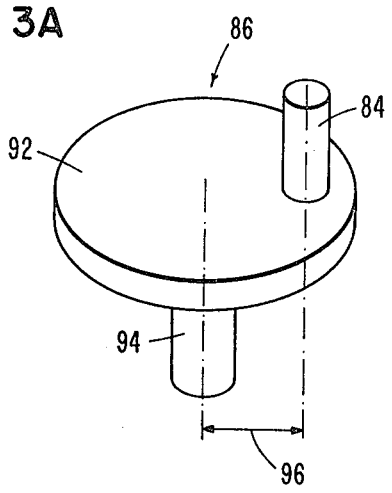
FIG. 3A and 3B show the detail of the indexing mechanism.
Figure 3B:
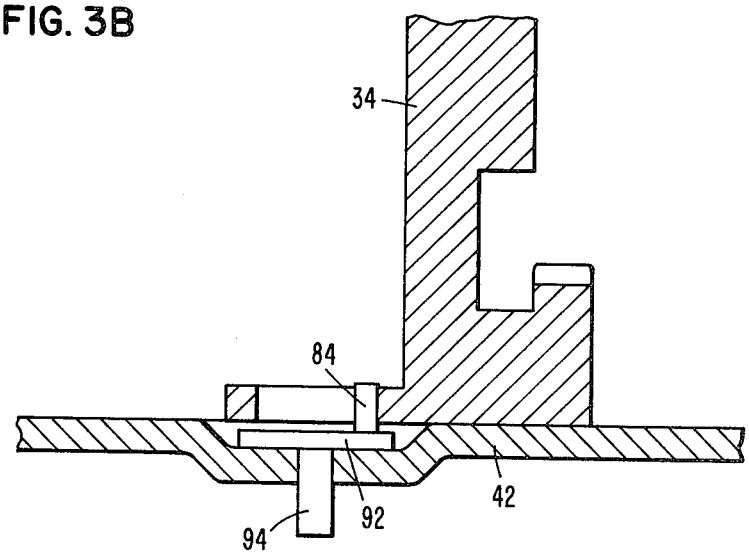

Referring to FIG. 3A for a moment, a pictorial view of the selector lever is shown. The selector lever has a substantially circular selector disk 92. A shaft 94 extends from the center of said disk. Shaft 84 is being offset radially from shaft 94. As is evident from FIG. 3B, shaft 94 is journaled for rotation in the base member 42 of the collator, while shaft 84 is rotated in elongated slot 50 of rack gear 36. As was stated previously, rack gear assembly 38 is fitted with an adjustment mechanism similar to that described and shown in relationship with rack gear assembly 36.

In order for the bin bottom walls (FIG. 4) to be properly aligned with the vertical walls, the rack gear assemblies 36 and 38 with the associated throat plate must be indexed; that is, moved a distance less than the spacing between adjacent bin bottom wall member 64' and 64''. Likewise, the spacing 96 between shaft 94 and 84 (FIG. 3A) respectively must be equal to one half the rack gear assembly index travel.

Figure 7:
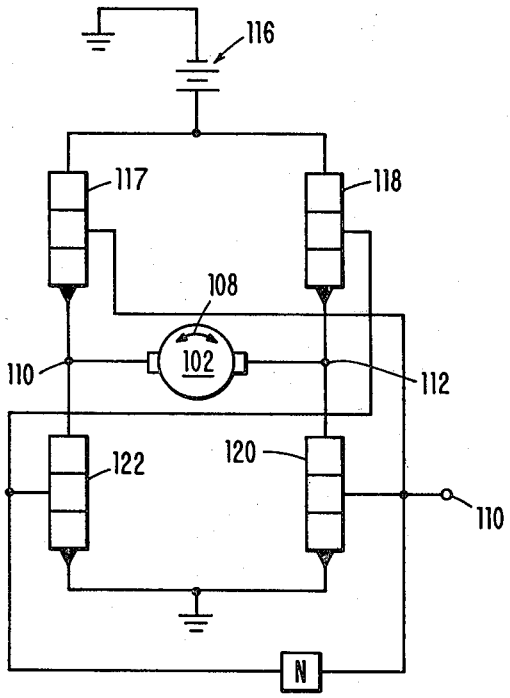
FIG. 7 shows a controller for driving the indexing mechanism.

Referring now to FIG. 7, an alternate automatic index mechanism which adjusts the rack gear and its attachment so as to effectuate front stacking or back stacking is shown. The arrangement is particularly suitable for use with an electrophotographic copier having a duplex function. The duplex function allows an electrophotographic machine to copy both sides of an original document on opposite sides of the same sheet of paper. As was stated previously and shown in FIGS. 2, 3A and 3B, the indexing mechanism includes a pair of selector levers, only one of which is shown and identified as 86. Selector lever 86 is fitted into selector slot 50. The shaft 94 is rotatably fitted into the base of the collator.

Locking screws 98 and 99 are fitted into elongated holes 46 and 48 respectfully. The locking screws retain the collator firmly to the collator base and in alignment with the fixed module or vertical walls of the collator. The other selector lever (not shown) and a similar pair of locking screws (not shown) are positioned on rack gear assembly 38. The function and arrangement of the locking screws and selector lever are identical to the function and arrangement of locking screws 98, 99 (FIG. 2) and selector lever 86 (FIG. 3A). This being the case, the locking screws and selector lever which are not shown in the figure will not be further described. Suffice it to say that by loosening the locking screws and rotating the selector levers about shaft 94 (FIG. 3A), the throat plate of the collator aligns with the fixed walls to form either a back stack or front stack collator.

Figure 5:
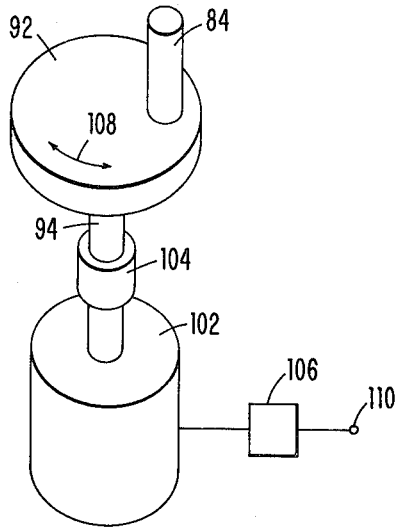
FIG. 5 shows an alternate indexing mechanism. The indexing mechanism indexes the throat plate dynamically.

Referring now to FIG. 5, in the automatic arrangement a rotary solenoid 102 is connected by coupler 104 to shaft 94. The rotary solenoid is driven by controller 106 and rotates in the direction shown by arrow 108. When an enabling electrical signal is applied to terminal 110, the rotary solenoid rotates the selector lever bidirectionally to achieve front stacking or back stacking. Of course, the rotary solenoid may be replaced by a motor or other motive means without departing from the scope of the present invention. A similar solenoid and controller (not shown) are connected to the selector lever (not shown) which is mounted on rack gear assembly 38 (FIG. 2). The locking screws 99 and 98 are loosely fitted in elongated holes 46 and 48 respectively. With loosely fitting screws, the rack gear assemblies and the throat plate attachment can be easily adjusted without human intervention. In the preferred embodiment, the locking screws are shoulder screws.

Referring now to FIG. 7, a controller suitable for driving the rotary solenoid is shown. The rotary solenoid 102 is connected across nodes 110 and 112, respectively, of a bridge circuit. The rotary solenoid is such that it can rotate clockwise or counter-clockwise in the direction shown by arrow 108. The bridge circuit includes a plurality of active electrical elements 117, 118, 120 and 122. In the preferred embodiment of the invention, the active elements are transistors. Of course, other types of active electrical elements such as relays may be used without departing from the scope of the present invention. A power source 116 is connected to the bridge circuit and supplies the necessary electrical current for rotating the solenoid. In operation an enabling electrical signal is supplied to terminal 110. The enabling signal can be generated from the duplex button which is usually positioned on the panel of an electrophotographic copier having a duplex function. The enabling signal on terminal 110 forward bias transistors 117 and 120 respectively. With the transistors forward bias, that is in a conducting mode, current outputted from power source 116, flows through transistor 117, to node 110 and through rotary solenoid 102 to node 112. From node 112 the current flows through transistor 120 to ground. Simultaneously, the signal on terminal 110 is inverted by inverter 118 and is fed to the base of transistors 118 and 122 to reverse bias said transistors. As such, when transistors 117 and 120 are conducting, the rotary solenoid rotates in a first clockwise direction. Simultaneously, transistors 122 and 118 are off.

In order to rotate the solenoid in the counter-clockwise direction, the polarity of the enabling signal on terminal 110 is changed. The transistors 120 and 117 are now reversed biased and remain in a nonconducting state. The enabling signal is now inverted by inverter 118 and forward bias transistors 118 and 122, so that said transistors are in a conducting state. With transistors 118 and 122 in a conducting state, current which is drawn from power source 116 is conveyed through transistor 118 to node 112. From node 112 the current flows through rotary solenoid 102 to node 110. From node 110 the current flows through transistor 122 to the ground. It is worthwhile noting that although FIGS. 7 and 5 show a preferred means for selectively indexing the movable module of the universal collator, it is within the skill of the art to devise other means without departing from the scope and spirit of the present invention.

What is claimed is:

1. Sorting device for collating sheets received from a sheet distributing device comprising:

a fixed module having a plurality of bin side wall members;

a movable module having a plurality of alternate sheet entry slots, and bin bottom wall members therein, said movable module being independently adjustable relative to the fixed module; and indexing means operable to adjust the movable module so that the bin bottom wall members are movable into alternative alignments with the bin side wall members to form a plurality of bottom entry bins.

2. Sorting device for collating sheets received from a sheet distributing device comprising:

a plurality of bin side wall members;

an adjustable throat plate having a plurality of openings therein and a plurality of bin bottom wall members;

indexing means operable to adjust the throat plate so that the bin bottom wall members are movable into alternative alignments with the bin side wall members to form a plurality of bottom entry bins; and a sheet delivery mechanism associated with the adjustable throat plate and operable to deliver sheets through the openings of said throat plate into the bins.

3. Sorting device for collating sheets received from a sheet distributing device comprising:

a plurality of bin side wall members;

an adjustable throat plate having a plurality of openings therein and a plurality of bin bottom wall members;

indexing means operable to adjust the throat plate so that the bin bottom wall members are being aligned with the bin side wall members to form a plurality of bins, said indexing means including a pair of spaced gear racks running in a direction substantially perpendicular to the bin side wall members;

each of said gear racks having a pair of spaced elongated holes positioned therein;

a pair of locking screws; one of each operably associated with the elongated holes;

an intermediate elongated hole positioned between the spaced elongated holes; said intermediate elongated hole running in a direction substantially perpendicular to the spaced elongated holes; and a selector lever associated with said intermediate elongated hole and operable to lock in one of two positions whereby the bin bottom walls are selectively in alignment with adjacent bin side walls.

4. The device of claim 3 wherein the selector lever includes a substantially circular member with a pair of offset pins connected to said member.

5. The device of claim 4 wherein the offset distance between the offset pins is substantially equivalent to one-half of the distance travel by the gear rack and the attached throat plate in order to achieve alignment with the bin side wall members.

6. The device of claim 3 where the distance of travel of the gear rack and attached throat plate is less than the spacing between adjacent side wall members.

7. An improved collator/sorting device for use with an electrophotographic apparatus comprising in combination:

a plurality of compartments having at least two facing side wall members;

an adjustable throat plate having a plurality of alternate slots and solid sections said solid sections serving as bottom sheet support members;

a sheet delivery means associated with the adjustable throat plate and operable to deliver sheets through said slots; and indexing means selectably operable in one of two modes for positioning said throat plate relative to the side wall members to form bins so that sheets delivered through the slots will be supported by one of said side walls when one of said modes is being selected and on the other side wall when the other of said modes is being selected.

* * * * *